US007706120B2

(12) United States Patent
Seto et al.

(10) Patent No.: US 7,706,120 B2
(45) Date of Patent: Apr. 27, 2010

(54) ION GENERATING ELEMENT, ION GENERATOR AND NEUTRALIZER

(75) Inventors: Takafumi Seto, Tsukuba (JP); Makoto Hirasawa, Tsukuba (JP); Masaaki Tsuji, Tsukuba (JP); Akira Okuyama, Tokyo (JP); Susumu Saito, Tokyo (JP)

(73) Assignees: National Institute of Advanced Industrial Science and Technology, Ibaraki (JP); FISA Corporation, Tokyo (JP)

( * ) Notice: Subject to any disclaimer, the term of this patent is extended or adjusted under 35 U.S.C. 154(b) by 421 days.

(21) Appl. No.: 11/884,488

(22) PCT Filed: Feb. 20, 2006

(86) PCT No.: PCT/JP2006/302956

§ 371 (c)(1),
(2), (4) Date: Aug. 16, 2007

(87) PCT Pub. No.: WO2006/088183

PCT Pub. Date: Aug. 24, 2006

(65) Prior Publication Data

US 2009/0207548 A1 Aug. 20, 2009

(30) Foreign Application Priority Data

Feb. 21, 2005 (JP) ..... 2005-043456

(51) Int. Cl.
*H01T 23/00* (2006.01)

(52) U.S. Cl. ..... 361/231

(58) Field of Classification Search ..... 361/231
See application file for complete search history.

(56) References Cited

U.S. PATENT DOCUMENTS

| | | | | |
|---|---|---|---|---|
| 4,628,227 | A * | 12/1986 | Briere | 315/111.81 |
| 4,922,099 | A * | 5/1990 | Masuda et al. | 250/324 |
| 5,404,157 | A * | 4/1995 | Hosaka et al. | 347/128 |
| 6,621,191 | B1 * | 9/2003 | Nomura et al. | 310/309 |
| 7,564,671 | B2 * | 7/2009 | Kato et al. | 361/231 |

FOREIGN PATENT DOCUMENTS

| | | |
|---|---|---|
| JP | 56-040238 | 4/1981 |
| JP | 02-117699 | 5/1990 |
| JP | 03-049198 | 3/1991 |
| JP | 04-149995 | 5/1992 |

(Continued)

*Primary Examiner*—Stephen W Jackson
(74) *Attorney, Agent, or Firm*—Roylance, Abrams, Berdo & Goodman, L.L.P.

(57) ABSTRACT

An ion generating element capable of cost reduction and space saving while exhibiting a high generation efficiency of positive ions and negative ions and stabilized generation capacity with less variation, and an ion generator and a neutralizer employing it. The ion generating element comprises a dielectric body having at least two faces, at least two discharge electrodes arranged on the at least two faces of the dielectric body, and an induction electrode arranged in the dielectric body and subjected to the action of the at least two discharge electrodes and is characterized in that positive ions and negative ions are generated on the body, and ions are generated from the at least two faces of the dielectric body through discharge generated because of the potential difference between the discharge electrode of the ion generating element and the induction electrode when a drive voltage is applied between them.

10 Claims, 12 Drawing Sheets

FOREIGN PATENT DOCUMENTS

| | | | |
|---|---|---|---|
| JP | 09-007735 | | 1/1997 |
| JP | 2003-249327 | A | 9/2003 |
| JP | 2003-323964 | A | 11/2003 |
| JP | 2004-105517 | A | 4/2004 |
| JP | 2004-164900 | | 6/2004 |

* cited by examiner

ION GENERATING ELEMENT, ION GENERATOR AND NEUTRALIZER

TECHNICAL FIELD

The present invention relates to an ion generating element, an ion generator and a neutralizer, and in particular, to an ion generating element which is capable of preventing neutralization of positive ions and negative ions generated on fine electrodes and generating ions efficiently and moreover includes a simple electrode structure by having an induction electrode in common, and an ion generator and a neutralizer with the use of the element.

BACKGROUND ART

Of general conventional ion generators and neutralizers, a conventional neutralizer, for example, applies a high voltage to an acuminate needle-shaped ion generating electrode by a high voltage power supply so as to induce corona discharge, thereby ionizing air. Since the needle-shaped ion generating electrode needs to induce corona discharge efficiently between an opposed ground electrode and itself, a certain insulation distance needs to be ensured. Accordingly, there is a problem that space for constituting ion generation is constrained and thus limitations on size reduction of an efficient ion generator and neutralizer arise.

In addition, the needle-shaped ion generating electrode over long-term use induces corona discharge with difficulty due to influences of buildup of dust and abrasion of physical sputtering, so that ion generating efficiency tends to be reduced. As regards the ground electrode opposed to the needle-shaped ion generating electrode and provided to stabilize discharge, too, buildup of dust is caused and dirt on its surface is advanced because of electrostatic adsorption due to high voltage and physical sputtering of the ion generating electrode. This also results in reduction of ion generating efficiency.

Consequently, a user is constrained to maintenance work to improve ion generating efficiency such as cleaning or replacing the acuminate portion of the needle-shaped ion generating electrode and cleaning the ground electrode and its periphery at regular intervals. Since the maintenance work is the cleaning of an interior of the structure with the acuminate portion, which is also a part where a high voltage is applied, the work is dangerous and troublesome.

For this reason, a tabular ion generating element provided with a discharge electrode and an induction electrode on a tabular but not needle-shaped dielectric has been developed (See Patent document 1 to 3).

Patent document 1: Japanese Unexamined Patent Publication No. 2003-323964

Patent document 2: Japanese Unexamined Patent Publication No. 2003-249327

Patent document 3: Japanese Unexamined Patent Publication No. 2004-105517

DISCLOSURE OF THE INVENTION

Related art as disclosed in Patent documents 1 to 3 locally discharges by applying a high voltage power supply between a discharge electrode and an induction electrode via a dielectric body so as to generate ions. As a result, the related art has a flat shape without a physically acuminate structure. The employment of the local discharge makes it possible to generate an equivalent amount of ions with a lower voltage and less power consumption than the needle-shaped ion generating electrode. Furthermore, forming an insulation protecting layer formed by a coating layer on the discharge electrode makes possible improvements in deterioration of the electrode, current leakage toward a creepage and maintainability. As a result, the problem the needle-shaped ion generating electrode has is alleviated.

However, the ion generation by the electrode structure formed via the dielectric body as described above comes to have high impedance between the electrodes unless a relatively high frequency electric power is supplied. Accordingly, efficiency is remarkably lowered, rendering generation of ions impossible.

In ion generating elements, each of which periodically generates positive and negative ions by turn by applying an alternating current (AC) power supply, since intervals of the generation time of positive and negative ions are very short in the case of applying a high frequency high voltage power supply, generated ions are neutralized with anti-polar ions to be generated in the subsequent cycle, resulting in electrical stabilization and difficulty in sputtering ions. Accordingly, the ion generating elements have a disadvantage that the generation efficiency as a whole is reduced (See FIG. 21).

In the case of applying a high voltage power supply having a direct-current component containing a high frequency component which is easy to adjust the ion concentration (a pulse wave, for example), positive ions generated by applying the high voltage power supply having a positive polar direct-current component are sputtered widely under the repulsion by Coulomb force, making possible prevention of the neutralization, compared with the case of applying the high frequency high voltage power supply as described above. However, ions with only either one of the polarities are generated. In the case of an ion generator or neutralizer requiring bipolar ions, at least another unit of the device, that is, two units of the devices in total are required. Consequently, an advantage in terms of cost and space saving cannot be expected.

When bipolar ions are required, at least two ion generating elements are used to generate positive and negative ions, for example. However, variations in an ion generating ability are easily caused depending on the physical relationship of installation between each of the ion generating elements. More specifically, when a distance between the respective ion generating elements is relatively close, ion generating efficiency as a whole is lowered due to the neutralization among ions generated. When the distance between the ion generating elements is increased, a place where ions are not balanced spatially occurs. As a result, when applications with different purposes and sizes are commercialized, an optimum condition needs to be extracted in consideration of an ability gap resulting from the installation position of the ion generating elements, which largely influences cost when product expansion is considered.

Two ion generating elements can be made into one package so as to save space and to apply a direct-current high voltage power supply with each polarity. However, since a discharge electrode generating positive ions and a discharge electrode generating negative ions are spatially adjacent, the neutralization by mixture of the positive and negative ions is increased, whereby generating efficiency as a whole is reduced. Regarding the structure of the ion generating element, its cost advantage cannot be expected since it is equivalent to the case of manufacturing two elements (See FIG. 22).

Therefore, an object of the present invention is to provide an ion generating element having high generating efficiency of positive and negative ions and stable generating ability with small variations and also making possible cost reduction and space saving, an ion generator and a neutralizer employing the ion generating element.

The present invention to solve the foregoing problems includes the following.

1. An ion generating element comprising: a dielectric body with at least two faces; at least two discharge electrodes arranged on at least two faces of the dielectric body; and an induction electrode arranged inside of the dielectric body and subjected to an action of at least two discharge electrodes, wherein positive ions and negative ions are generated on the different faces of the dielectric body.

2. The ion generating element according to the above 1, wherein the dielectric body is a tabular member with a front face and a back face, and positive ions are generated from either one of the faces and negative ions are generated from the other face.

3. The ion generating element according to the above 1 or 2, wherein the number of the induction electrode is one.

4. The ion generating element according to any one of the above 1 to 3, wherein the discharge electrode is composed of a linear conductive material with a plurality of fine protrusions.

5. The ion generating element according to any one of the above 1 to 4, wherein the induction electrode is composed of a linear conductive material opposed to the discharge electrode.

6. An ion generator is constituted; wherein a driving voltage is applied between the discharge electrodes and induction electrode of the ion generating element according to any one of the above 1 to 5, and discharge caused according to a potential difference generates ions from at least two faces of the dielectric body.

7. The ion generator according to the above 6, further comprising a delivering means delivering generated ions by air flow.

8. The ion generator according to the above 7, wherein the dielectric body is arranged along a direction of the air flow so as to distribute a face generating positive ions and a face generating negative ions on both sides thereof directly to the direction of the air flow in order that the both faces are placed under equal air flow environments.

9. The ion generator according to any one of the above 6 to 8, further comprising an ion concentration adjusting means changing an ion amount of at least either of positive ions and negative ions to be generated.

10. A neutralizer performing diselectrification with use of the ion generator according to any one of the above 6 to 9.

According to the invention described in the above 1, an ion generating element having high generating efficiency of positive and negative ions and stable generating ability with small variations and also making possible cost reduction and space saving to be obtained.

In particular, in order to simultaneously generate both positive ions and negative ions, at least two ion generating elements need to be prepared conventionally. According to the present invention, however, both ions can be generated by one ion generating element. As a result, mounting space in an ion generator or a neutralizer can be saved to about a half of the conventional mounting space. In addition, as for man-hours for maintaining the ion generating element, too, man-hours for replacing and cleaning the element are reduced to about a half of the convention, permitting a cost reduction.

According to the invention described in the above 2, the dielectric body includes a tabular member having a front face and a back face. Positive ions and negative ions are generated in a spatially separated state by the configuration wherein positive ions are generated on either one of the faces and negative ions are generated on the other. Since the neutralization (counteraction) is reduced, ion generating efficiency is exceedingly good.

Furthermore, since a physical relationship where positive and negative ions are generated is always constant, ion generating ability is also constant. An ability gap due to an influence of interference by respective polarities of the ion generating elements is difficult. Consequently, when applications with different purposes and sizes are commercialized, extraction of an optimum condition is simplified, thereby facilitating product expansion and enabling to provide products at a lower cost and with speed.

According to the invention described in the above 3, cost reduction, mass production and space saving are made possible by constituting to have one induction electrode, that is, by commonalizing an induction electrode subjected to an action of discharge electrodes for both ions of a discharge electrode generating positive ions and a discharge electrode generating negative ions.

According to the invention described in the above 4, the constitution that the discharge electrode is fine and of a plurality contributes to space saving and electric power reduction.

According to the invention described in the above 5, the induction electrode is composed of a linear conductive member opposed to the discharge electrode, whereby the physical relationship of the induction electrode with respect to the discharge electrode becomes constant, and stable ion generation can be obtained.

According to the invention described in the above 6, an ion generator having high generating efficiency of positive and negative ions and stable generation ability with small variations and also making possible cost reduction and space saving to be obtained by means of an ion generator including the ion generating element according to the first to fifth aspects of the invention.

According to the invention described in the above 7, since a delivering means delivering generated ions by air flow is provided, generated ions can be delivered easily.

According to the invention described in the above 8, the dielectric body is arranged along a direction of the air flow so as to distribute a positive ion generating face and a negative ion generating face at both sides directly to the direction of the air flow. As a result, the positive ion generating face and negative ion generating face can be placed under equal air flow environments. Furthermore, the both ions[EH1] are generated in a space divided by the dielectric body and delivered by the air flow. Accordingly, the neutralization after the generation is small while generation efficiency is high.

According to the invention described in the above 9, an ion concentration adjusting means changing an ion amount of at least either of the positive ions and negative ions to be generated is provided. Consequently, adjustment of an ion balance is facilitated.

According to the invention described in the above 10, since the diselectrification is implemented by the ion generator according to the sixth to ninth aspects of the invention, generating efficiency of positive and negative ions is high, generating ability is stable with small variations, cost reduction and space saving are made possible and stable and efficient diselectrification can be performed.

BEST MODE FOR EMBODYING THE INVENTION

Details of an ion generating element of the present invention are described below with reference to the accompanying drawings.

An ion generating element according to the present invention has a constitution of generating positive ions and negative ions on the different faces of the dielectric in which a dielectric body with at least two faces, at least two discharge electrodes arranged on at least two faces of the dielectric and an induction electrode provided inside of the dielectric and subjected to an action of at least the two discharge electrodes are provided.

Figure 1:
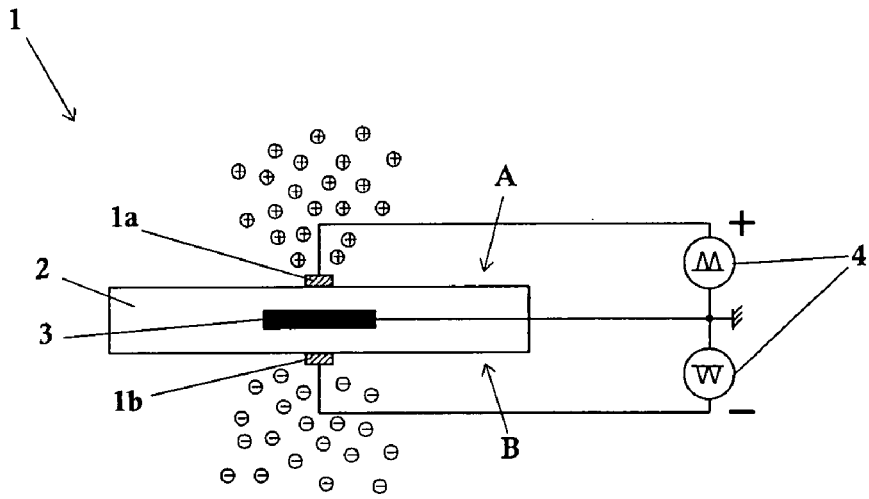
FIG. 1 is a block diagram of an example of an ion generating element according to the present invention.

More specifically, as shown in FIG. 1, an ion generating element 1 includes a dielectric body 2 with two faces of a front face A and a back face B. The front face A is formed with a discharge electrode 1*a* and the back face B is formed with a discharge electrode 1*b* by micromachining. Inside of the dielectric body 2, an induction electrode 3 is provided so as to be opposed to the discharge electrodes 1*a* and 1*b*. The induction electrode 3 is subjected in common to an action of both of the discharge electrodes 1*a* and 1*b*, and is provided so as to be surrounded by the dielectric body 2. In other words, the induction electrode 3 is buried and embedded inside of the dielectric body 2. The induction electrode 3 may be one or a plurality with respect to one ion generating element 1. Moreover, one induction electrode 3 may be provided with respect to a plurality of the ion generating elements 1.

The ion generating element 1 can divide a space into at least two of a front face A side and a back face B side with the dielectric body 2 itself making a boundary. Therefore, when positive ions are generated from the front face A and negative ions, from the back face B, in other words, when positive ions and negative ions are generated on the different faces (the front face A and back face B) of the dielectric body 2, generated ions are respectively separated spatially by the dielectric body 2 itself. As a result, neutralization (counteraction) due to mixture of positive ions and negative ions can be suppressed.

Unlike the conventional ion generating elements of generating positive and negative ions periodically by applying a high frequency high voltage power supply or of generating positive and negative ions by making two ion generating elements into one package, ion generating efficiency is good because of generating positive and negative ions on the front and back faces A and B. When both polarities of positive ions and negative ions are required, a space necessary for mounting can be saved to about a half, compared with the constitution where each of the conventional ion generating elements is prepared. As for man-hours for maintaining the ion generating element, too, man-hours for replacing and cleaning the element are reduced to about a half. Accordingly, cost reduction is made possible.

In addition, the ion generating element 1 is configured such that the discharge electrodes 1*a* and 1*b* and induction electrode 3 are integrated. Since the physical relationship of generating positive ions and negative ions can always be stabilized, ion generating ability becomes constant and an ability gap due to an influence of interference by each polarity of the ion generating elements 1 is difficult. Consequently, when applications with different purposes and sizes are commercialized, extraction of an optimum condition is simplified. Products can be provided speedily as well as product expansion being facilitated and cost reduction can be achieved.

Figure 2:
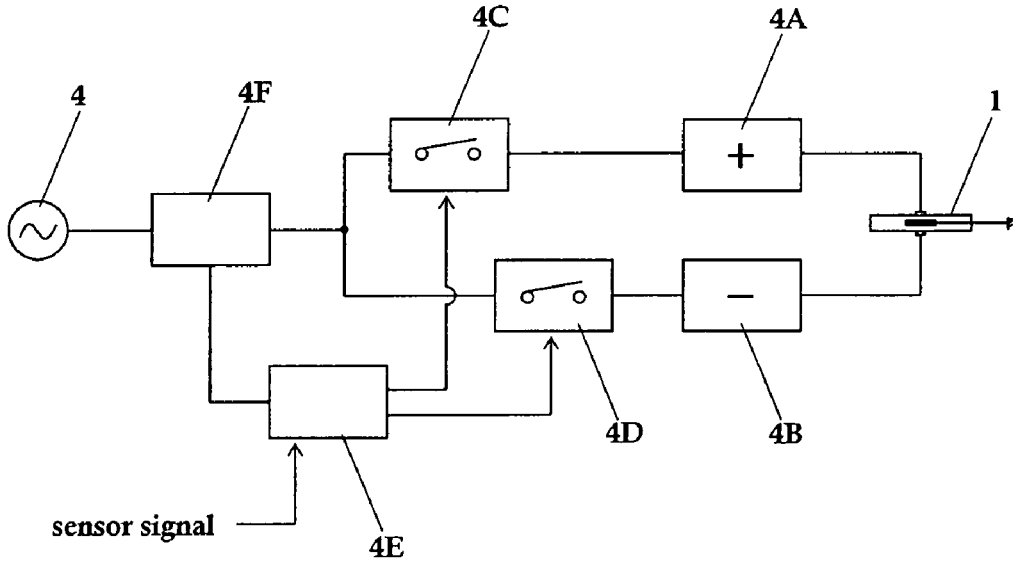
FIG. 2 is a circuit diagram of the above.

The ion generating element 1 as shown in FIG. 1 has a high voltage power supply with a direct-current component containing a high frequency component (hereinafter referred to as a DC power supply) as a power source 4. The element 1 has a constitution as shown in FIG. 2 as a concrete example of a circuit. The circuit example as shown in FIG. 2 includes a power source 4, a positive polar high voltage circuit 4A, a negative polar high voltage circuit 4B, transmitting circuits 4C and 4D, an output control circuit 4E and a power supply circuit 4F. According to the example as shown in FIG. 2, an ion balance can be easily adjusted by a conventional control system controlling on and off of an output voltage. Other than the foregoing, known control systems such as an output current control, a power supply bias control and an induction electrode bias control, for example, can be employed as an ion balance adjusting means. For a use requiring accuracy of the ion balance, a method for ensuring the accuracy, for example, by sensing conditions of ion generation, can also be adopted.

Figure 3:
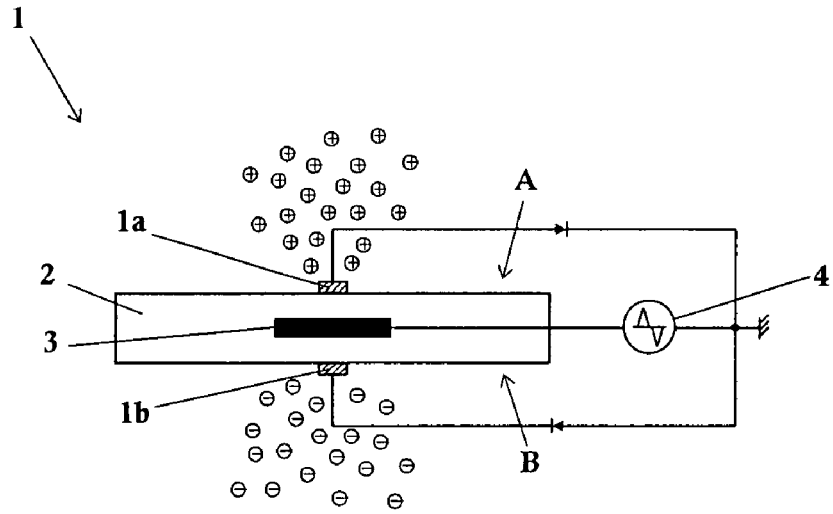
FIG. 3 is a block diagram of another example of the ion generating element according to the present invention.

In the ion generating element 1 of the present invention, not only the DC power supply but also an alternating current (AC) power supply may be used as shown in FIG. 3. In the case of the AC power supply, too, the ion generating element 1 has high generating efficiency of positive and negative ions and stable generation ability with small variations, and also cost reduction and space saving are made possible, similar to the case of the DC power supply. In connection with the ion balance adjusting means, too, the ion balance can be easily adjusted by employing known and used control systems similar to the DC power supply. Symbols shown in FIG. 3 represent members and constitutions of symbols described in FIG. 1.

Figure 4:
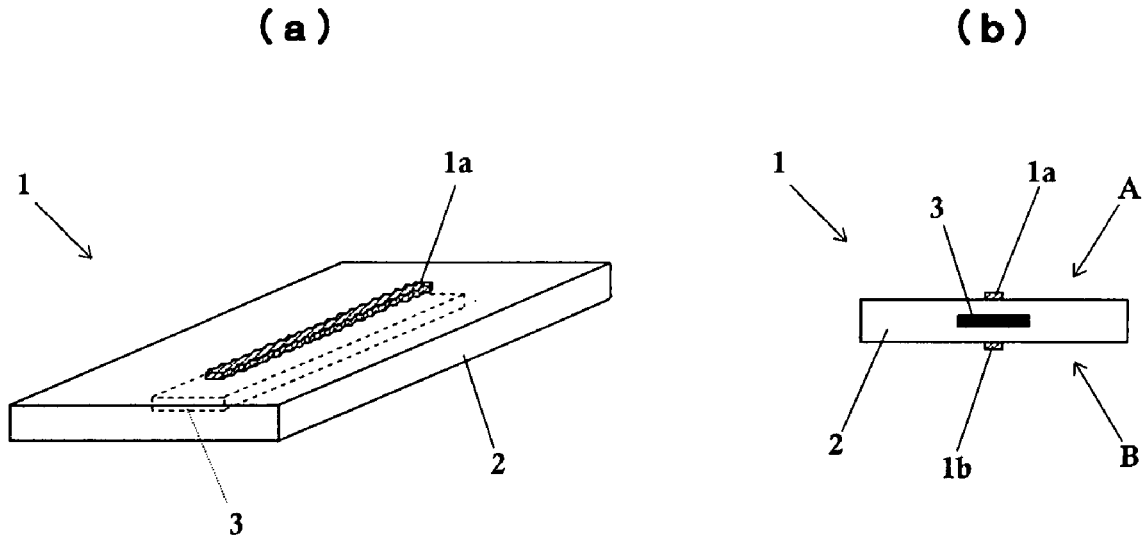
FIG. 4 is a perspective view and a sectional view of a constructional example of the ion generating element according to the present invention.

A constructional example of the ion generating element 1 of the present invention includes a constitutional example as shown in FIG. 4 {(*a*) is a perspective view and (*b*) is a sectional view}.

In the example as shown in FIG. 4, discharge electrodes 1*a* and 1*b* are formed on two places of a front face (A) and a back face (B) of a tabular dielectric body 2, respectively. An induction electrode 3 is formed so as to surround the dielectric body 2.

Figure 5:
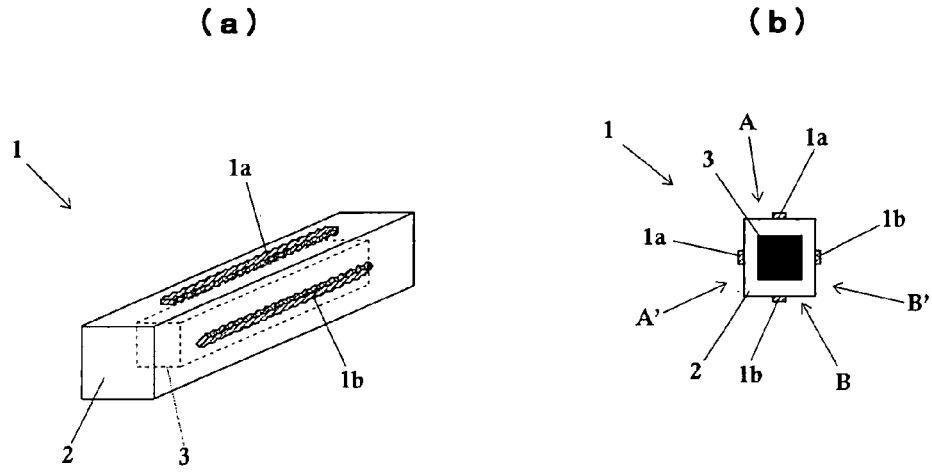
FIG. 5 is a perspective view and a sectional view of another constructional example of the ion generating element according to the present invention.

In addition, in examples as shown FIGS. 1, 3 and 4, the discharge electrodes 1*a* and 1*b* are arranged on the two faces [the front face (A) and back face (B)] of the tabular dielectric body 2. However, the present invention is not restricted to the two faces and two discharge electrodes, but may be provided with three or more discharge electrodes on three or more faces. However, the number of faces is preferably an even number capable of being divided by two in order to balance positive ions and negative ions. As for the number of discharge electrodes, the number of the discharge electrode 1*a* generating positive ions and the number of the discharge electrode 1*b* generating negative ions are preferably equal. For example, FIG. 5 {(*a*) is a perspective view and (*b*) is a sectional view} shows a form wherein four discharge electrodes (1*a*, 1*a*, 1*b* and 1*b*) are provided on four faces (A, A', B and B') of a rectangular columnar dielectric body 2. In the form as shown in FIG. 5, one induction electrode 3 can be subjected in common to an action of the four discharge electrodes (1*a*, 1*a*, 1*b* and 1*b*).

Figure 6:
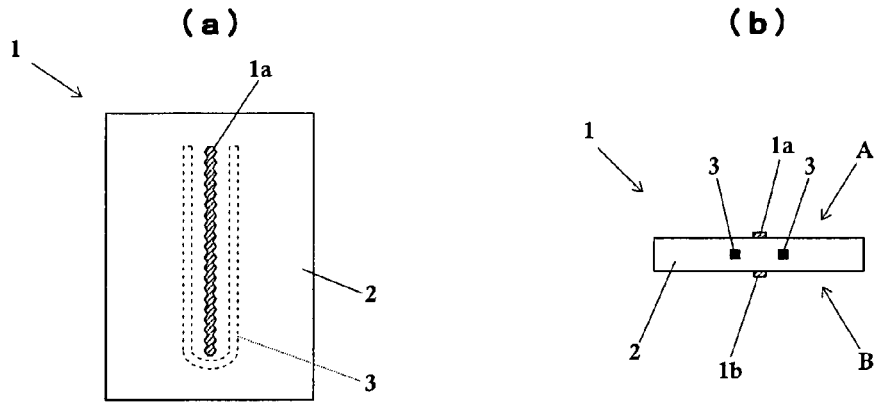
FIG. 6 is a plain view and a sectional view of an arrangement example of discharge electrodes and an induction electrode toward a dielectric body.
Figure 7:
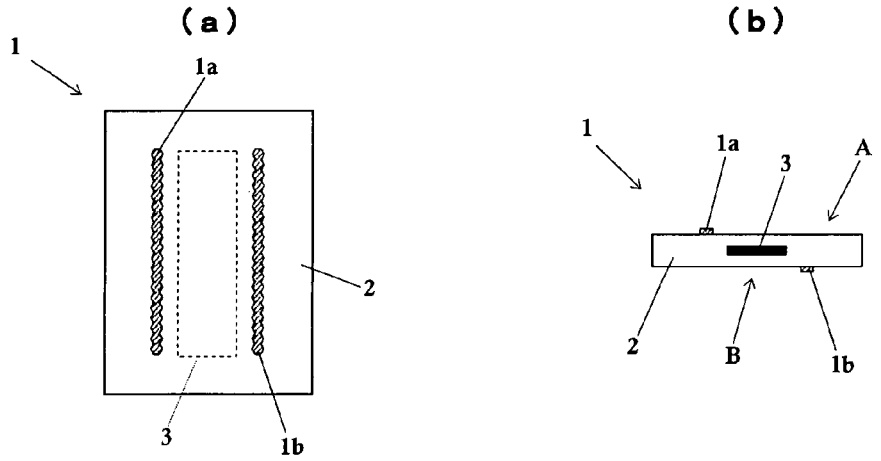
FIG. 7 is a plain view and a sectional view of an arrangement example of the discharge electrodes and the induction electrode toward the dielectric body.
Figure 8:
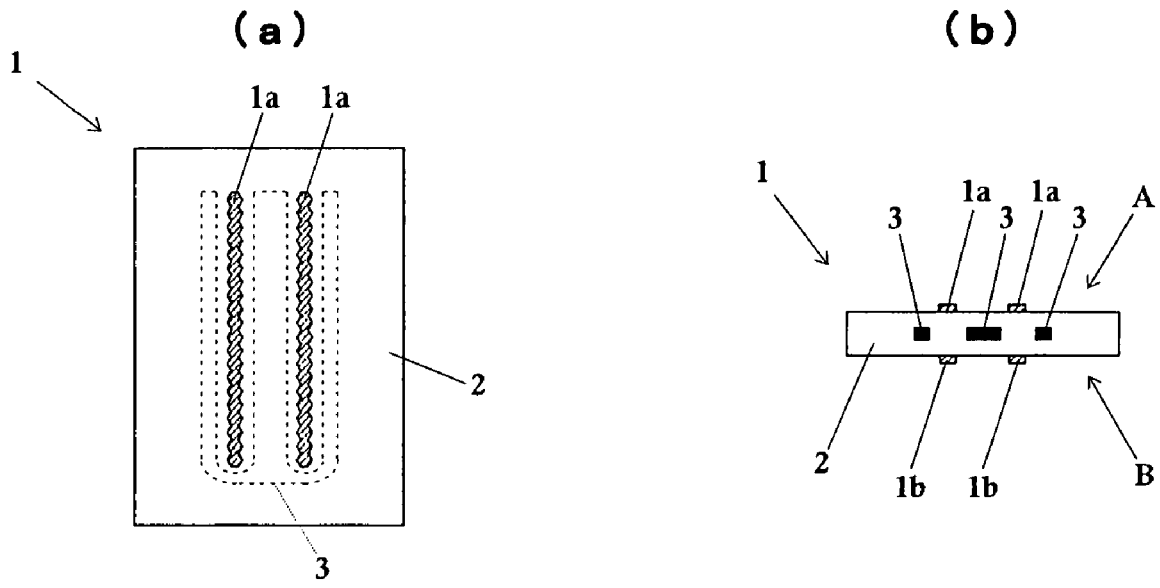
FIG. 8 is a plain view and a sectional view of an arrangement example of the discharge electrodes and the induction electrode toward the dielectric body.

As an arrangement example of the discharge electrodes 1*a* and 1*b* and induction electrode 3 to the dielectric body 2, a form as shown in FIGS. 6 to 8 can be applied in the case of the tabular ion generating element 1 as shown in FIG. 1 or 4. FIG. 6 {(*a*) is a plane view and (*b*) is a sectional view} is a form wherein an induction electrode 3 is arranged in the shape of a U. FIG. 7 {(*a*) is a plane view and (*b*) is a sectional view} is a form wherein discharge electrodes 1*a* and 1*b* are arranged so as to be obliquely shifted diagonally, making an induction electrode 3 the center. FIG. 8 {(*a*) is a plane view and (*b*) is a sectional view} is a form wherein an induction electrode 3 is arranged in the shape of an E and discharge electrodes (1*a*, 1*a*, 1*b* and 1*b*) are provided on a front face (A) and a back face (B) of groove portions of the E shape of the induction electrode 3.

A material of the discharge electrodes 1*a* and 1*b* used in the ion generating element 1 of the present invention is not restricted in particular as long as it possesses conductivity, and includes stainless steel, tungsten and conductive ceramics, for example. Materials are preferably difficult for the discharge electrodes 1*a* and 1*b* to deteriorate and fuse due to discharge. Endurance life of the discharge electrodes 1*a* and 1*b* can be extended if the electrodes 1*a* and 1*b* are protected so as to be covered with an insulation protecting layer such as a surface coating, depending on materials of the discharge electrodes 1*a* and 1*b* and usage purposes. At the same time, generation of dust from the discharge electrodes 1*a* and 1*b* can be reduced and their maintenance can be simplified. A material for the surface coating includes a diamond-like carbon (DLC) thin film coating, an epoxy insulating material, etc.

Figure 9:
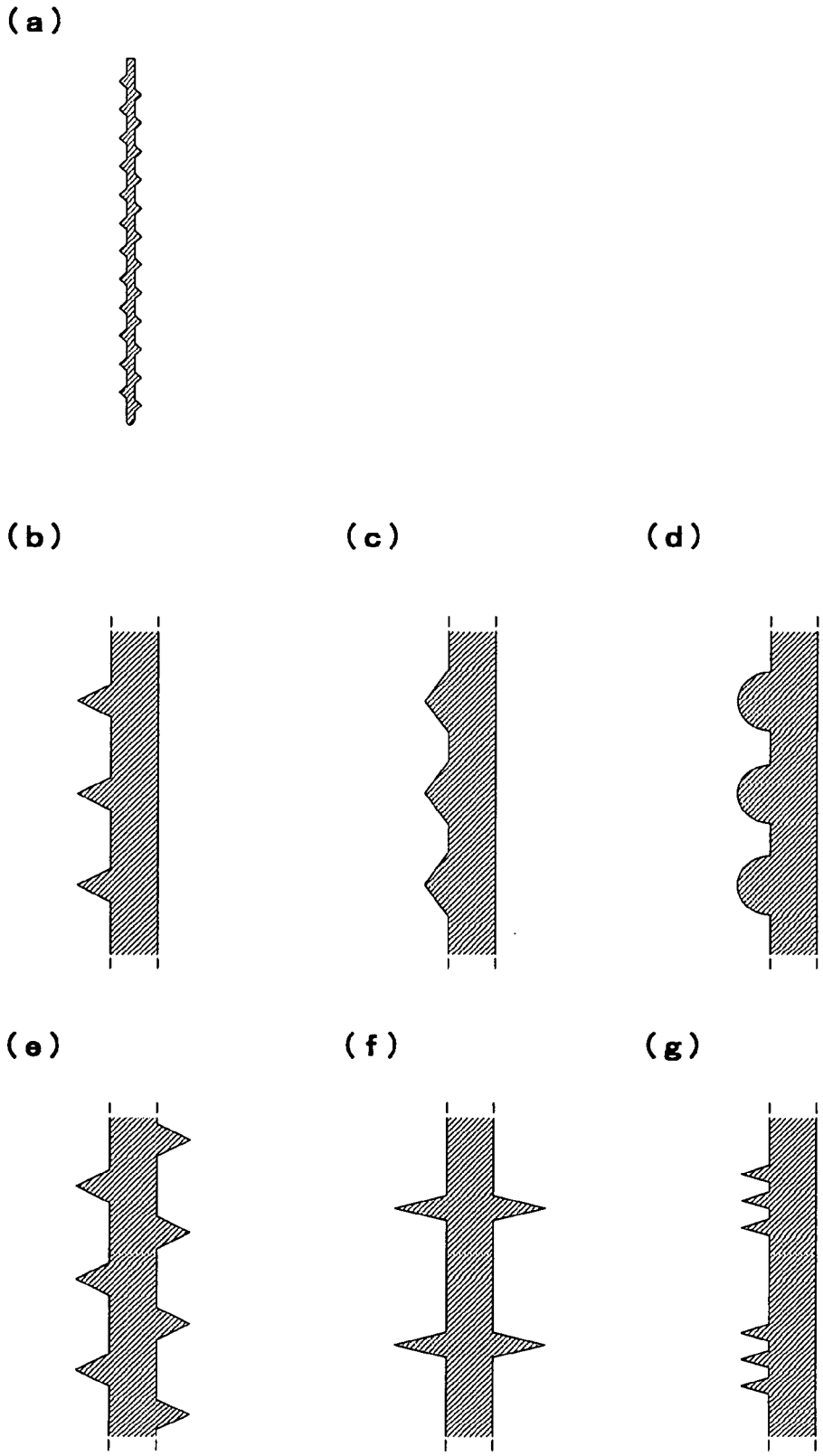
FIG. 9 is an explanatory diagram of a plurality of examples of protrusion shapes of the discharge electrode.

The discharge electrodes 1*a* and 1*b* desirably have a linear shape with a plurality of fine protrusions, which are preferably from 0.01 mm to 10 mm. The shape of the protrusions is not restricted in particular as long as it is capable of generating ions, and may be a shape as shown in FIG. 9*a*, for example, and may be other shapes such as a waveform, a circle, a lattice, etc. It is known that ion generating efficiency depends most on a relationship between a distance between the opposed induction electrode 3 and fine protrusions of the discharge electrodes 1*a* and 1*b* and the shape of the protrusions, compared with shape dependence of the discharge electrodes 1*a* and 1*b*. The shape is not particularly restricted as long as electric field concentration effectively occurs easily, and includes shapes as shown in FIGS. 9(*b*) to 9(*g*), for example. In addition, FIGS. 9(*b*) to 9(*g*) are partially enlarged views.

The dielectric body 2 used in the ion generating element 1 of the present invention is formed with the discharge electrodes 1*a* and 1*b* on each face [the front face (A), the back face (B), etc.] respectively so as to embrace the induction electrode 3. A distance between the discharge electrodes 1*a* and 1*b* formed on the each face and the induction electrode 3 formed so as to surround is controlled by a thickness of the dielectric body 2. The thickness is determined by permittivity of the dielectric body 2, and is preferably in the range of 0.01 to 5 mm. A shape of the dielectric body 2 is not particularly restricted as long as it has the foregoing structure such as a tabular shape, a circular shape, a rectangular columnar shape, a cylindrical shape, etc. A material for the dielectric body 2 includes dielectric materials such as alumina, glass, mica, etc. Laminating the dielectric material in molding can suppress dielectric breakdown due to a pinhole of the material, making possible improvement in the withstand voltage.

Known and used methods can be employed for formation of the discharge electrodes 1*a* and 1*b* on the dielectric body 2. In the present invention, formation by ink jet printing, silk-screen printing or screen printing is preferred.

The discharge electrodes 1*a* and 1*b* have a structure without a physically acuminate portion, unlike conventional needle-shaped ion generating electrodes. Since driving with low voltage has become possible due to high ion generating efficiency, the risk in the case of touching the ion generating element 1 during maintenance has been reduced.

In addition, an amount of ions to be generated from both of the discharge electrodes 1*a* and 1*b* can be adjusted by controlling the distance between the discharge electrodes 1*a* and 1*b* and induction electrode 3 by the thickness of the dielectric body 2, for example, by lengthening the distance between the discharge electrode 1*b* and induction electrode 3 with respect to the distance between the discharge electrode 1*a* and induction electrode 3. It is known that there is a difference in energy necessary for generation of positive ions and negative ions. Therefore, conventionally, an adjustment of an applied voltage source was required. However, the control of the thickness of the dielectric body 2 permits an adjustment of an ion generation level, too.

The induction electrode 3 is formed so as to be enclosed by the dielectric body 2, and acts as an electrode in common provided in an opposing relationship with respective discharge electrodes 1*a* and 1*b*. A material for the induction electrode 3 is not restricted in particular as long as it possesses conductivity, and includes stainless steel, tungsten, conductive ceramics, etc., for example.

Figure 10:
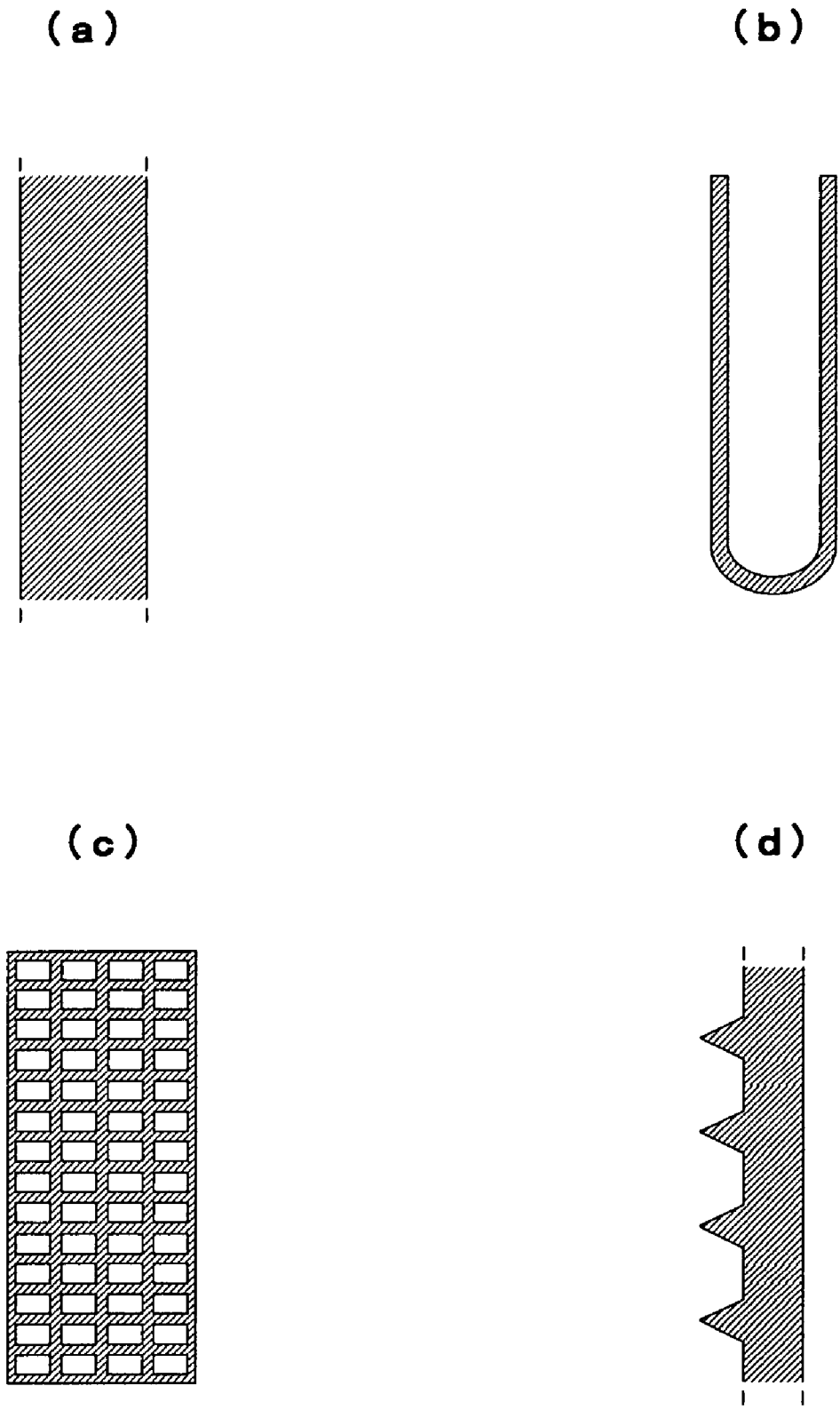
FIG. 10 is an explanatory diagram of a plurality of examples of shapes of the induction electrode.

A shape of the induction electrode 3 is not particularly restricted if the induction electrode 3 has an electrode structure opposed to the discharge electrodes 1*a* and 1*b*. Various shapes as shown in FIGS. 10(*a*) to 10(*d*) can be assumed, for example.

According to the ion generating element 1 with the foregoing constitution, a driving voltage is applied between electrodes of the discharge electrodes 1*a* and 1*b* and induction electrode 3. Discharge caused according to its potential difference generates positive ions from either one of the faces and negative ions from the other. Since positive ions and negative ions are generated in a spatially separated state, neutralization (counteraction) is reduced and ion generating efficiency becomes high. Furthermore, since the physical relationship of generating positive ions and negative ions is always stabilized, ion generating ability is also constant. An ability gap due to an influence of interference by each polarity of the ion generating element is difficult. Consequently, when applications with different purposes and sizes are commercialized, extraction of an optimum condition is facilitated, thereby rendering product expansion easy and realizing cost reduction. Moreover, products can be provided speedily.

Figure 11:
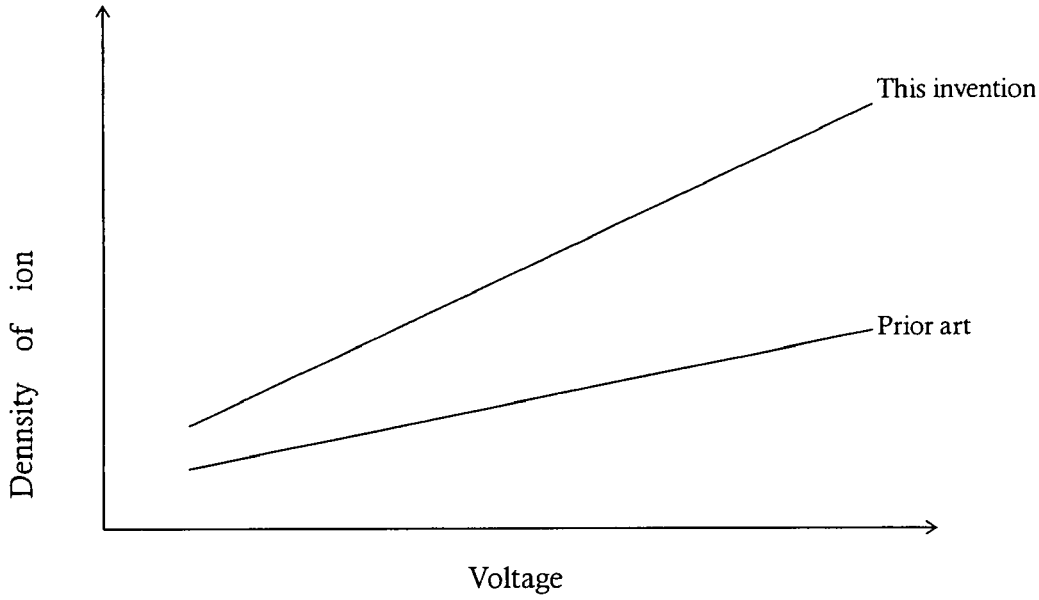
FIG. 11 is a comparative diagram of ion concentration between a conventional ion generating element and a multi-faceted ion generating element of the present invention.

FIG. 11 is a comparative diagram of ion concentration between an ion generating element 1 of the present invention and an ion generating element made by one-packaging two conventional ion generating elements. As obvious from FIG. 11, the ion generating element 1 is superior in ion generating efficiency to the conventional element.

An ion generating system with the use of voltage-applied corona discharge sometimes has a problem in that ozone concentration is increased as ion concentration is increased. This is not exceptional for the ion generating element of the present invention. However, it is found that the problem can be avoided by preventing electric field concentration between faces in the action of the discharge electrodes 1*a* and 1*b* and induction electrode 3 and by suppressing a current value between the electrodes (for example, reducing capacity coupling between the electrodes).

Next, an ion generator according to the present invention is described.

The ion generator of the present invention is constituted such that a driving voltage is applied between discharge electrodes and an induction electrode of an ion generating element as described above, and discharge caused according to its potential difference generates ions from at least two faces of a dielectric body.

Figure 12:
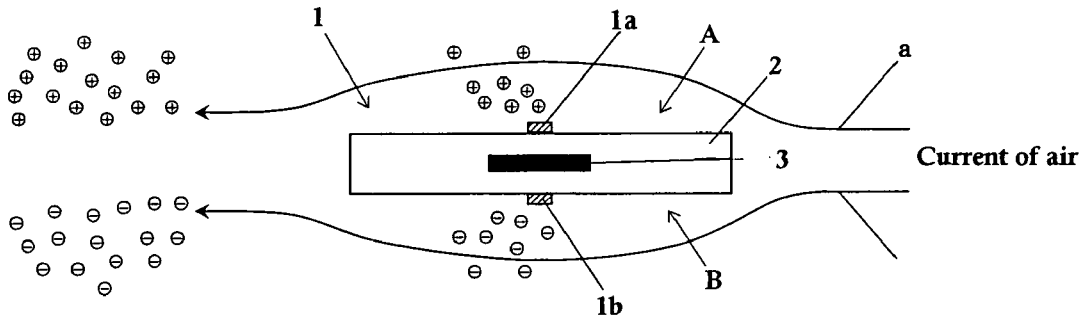
FIG. 12 is an explanatory diagram of an arrangement of the ion generating element relative to a direction of air flow.

The ion generator is preferably provided with a delivering means delivering generated ions by air flow. In this case, in order that both faces of a face (A) generating positive ions and a face (B) generating negative ions are placed under equal air flow environments, the dielectric body 2 is preferably arranged along a direction of the air flow so as to distribute the both faces (A) and (B) on both sides directly to the direction of the air flow (arrows a and b) as shown in FIG. 12. By this constitution, positive ions and negative ions are generated in a spatially separated state, whereby positive ions and negative ions are delivered by the distributed air flow while satisfactory generating efficiency where neutralization (counteraction) is reduced is held. Consequently, ion delivery efficiency is high.

In addition, the ion generator is preferably provided with an ion concentration adjusting means changing an ion amount of at least either of positive ions or negative ions to be generated.

Next, a neutralizer performing diselectrification with use of the foregoing ion generator is described based on the accompanying drawings. For a concrete constitution of the ion generator, reference can be made to the following description of the neutralizer.

Figure 13:
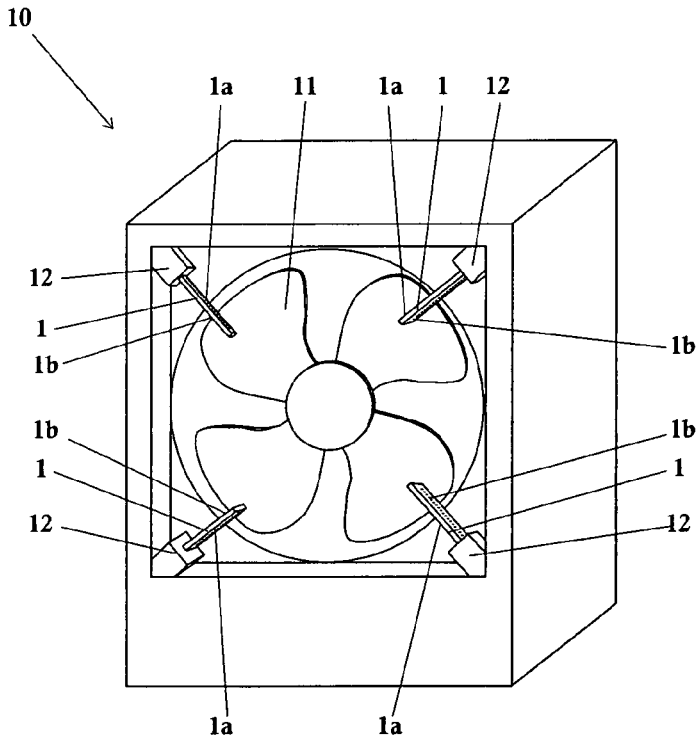
FIG. 13 is a perspective view of an example of a neutralizer according to the present invention.

First, a description is given for FIG. 13. An example as shown in FIG. 13 shows a neutralizer 10 equipped with an ion generator of the present invention generating ions by an ion generating element of the present invention and performing diselectrification by generated ions.

The neutralizer 10 is provided with an ion generating element 1 and a propeller fan 11 as a delivering means delivering ions generated by the ion generating element 1. In addition, illustration of a power supply is omitted. The neutralizer 10 is preferably provided with an adjusting means adjusting an ion balance and ion concentration.

Various configurations of the neutralizer 10 such as its size, its form, the number of the ion generating elements 1 to be arranged, delivering ability of the propeller fan 11 are determined as appropriate according to applications such as purposes and installation sites. The neutralizer 10 as shown in FIG. 13 is classified into a fan-type neutralizer employing the propeller fan 11 as a delivering means of ions.

Figure 14:
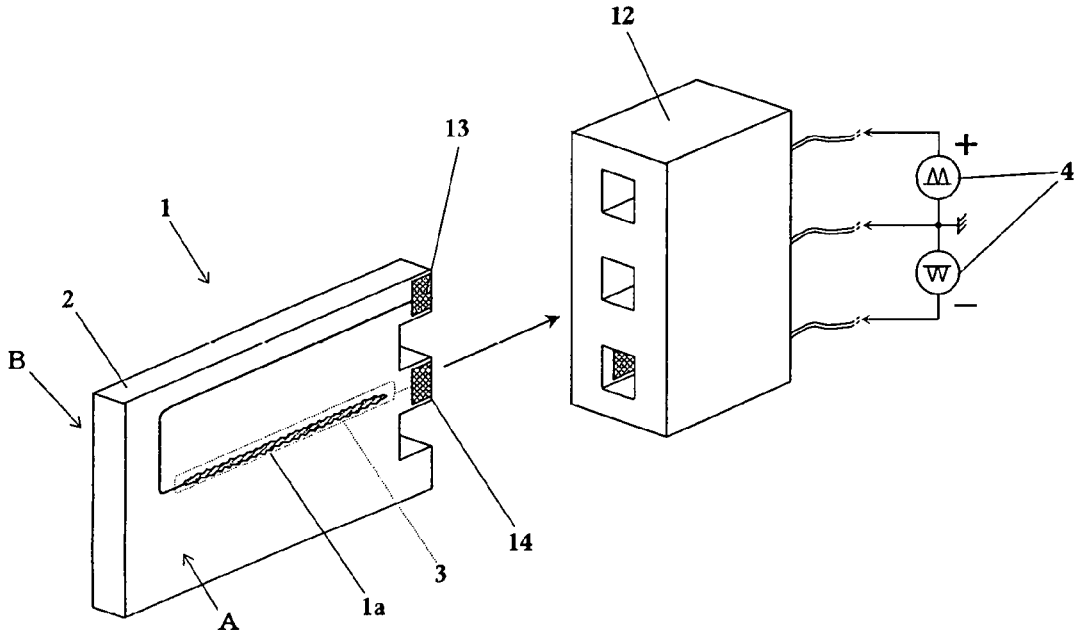
FIG. 14 is a perspective view of an example of an ion generating element with a detachable structure.

In this example, four ion generating elements 1 are provided around an outer periphery of the propeller fan 11 at intervals of a rotational angle of 90 degrees, making the center of the propeller fan 11 a base point. The elements 1 are arranged in front of the propeller fan 11 in order that generated ions are delivered efficiently. A method of mounting the ion generating element 1 to the neutralizer 10 is preferably such a method that the ion generating element 1 is arranged in air flow of the propeller fan 11 in order to deliver generated ions efficiently and a mounting part is provided outside of the air flow. A detaching means includes an example of mounting by inserting the ion generating element 1 into an electrode socket 12 as shown in FIG. 14. In this case, the mounting part does not interrupt the air flow if the electrode socket 12 is provided on the outer periphery under the air flow of the propeller fan 12.

Figure 20:
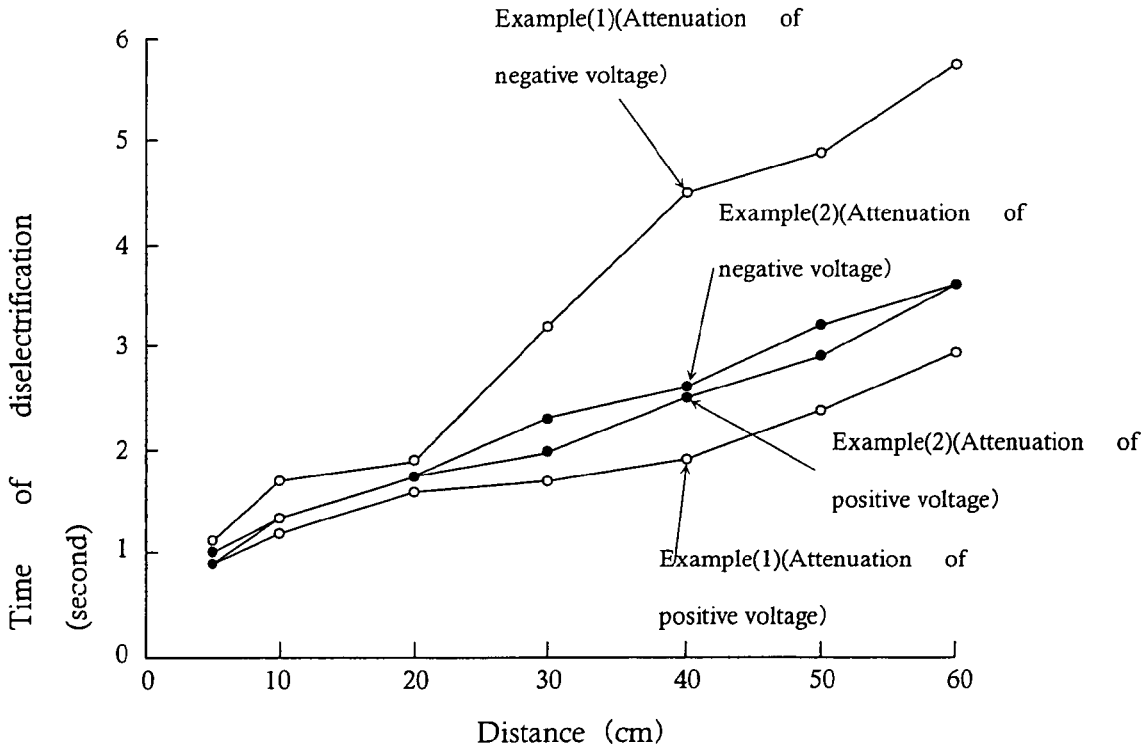
FIG. 20 is a graph of diselectrification properties of a neutralizer according to the present invention.
Figure 21:
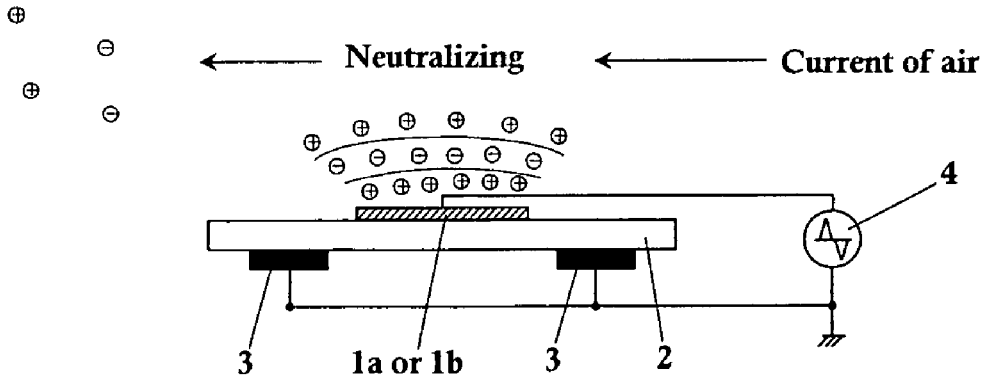
FIG. 21 is an explanatory diagram of an example of conventional ion generating elements, each of which periodically generates positive ions and negative ions by turn.
Figure 22:
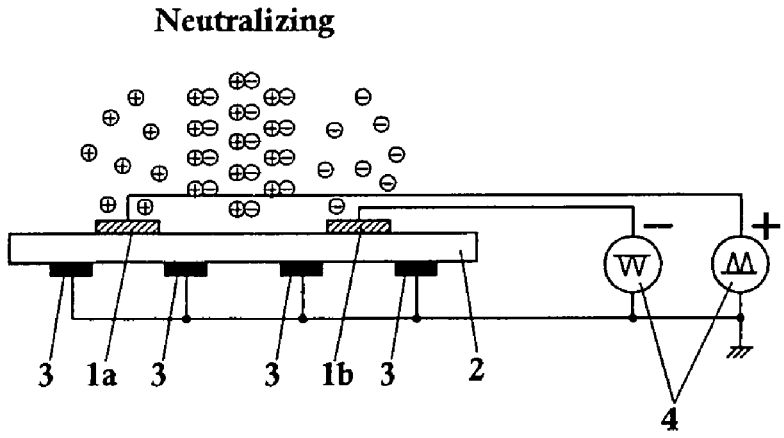
FIG. 22 is an explanatory diagram of an example of conventional ion generating elements generating positive ions and negative ions simultaneously by making two ion generating elements into one package.

With regard to an arrangement method for a plurality of the ion generating elements 1 in the neutralizer 10, the best diselectrification performance can be obtained when a positive ion generating face and a negative ion generating face are arranged not to be in the same space (or homopolar faces are arranged to face each other). Distance properties of diselectrification time are shown in FIG. 20. In Example (1) where positive ions and negative ions were present in the same space, the ion balance gradually came undone as the distance from an ion generating section became longer, and thus attenuation of negative voltage far exceeded attenuation of positive voltage. On the other hand, in Example (2) where the ion generating elements 1 were arranged so as to face the homopolar faces to each other, the ion balance was excellent even in a spot of 60 cm away, and almost the same diselectrification time in positive and negative was obtained.

Figure 16:
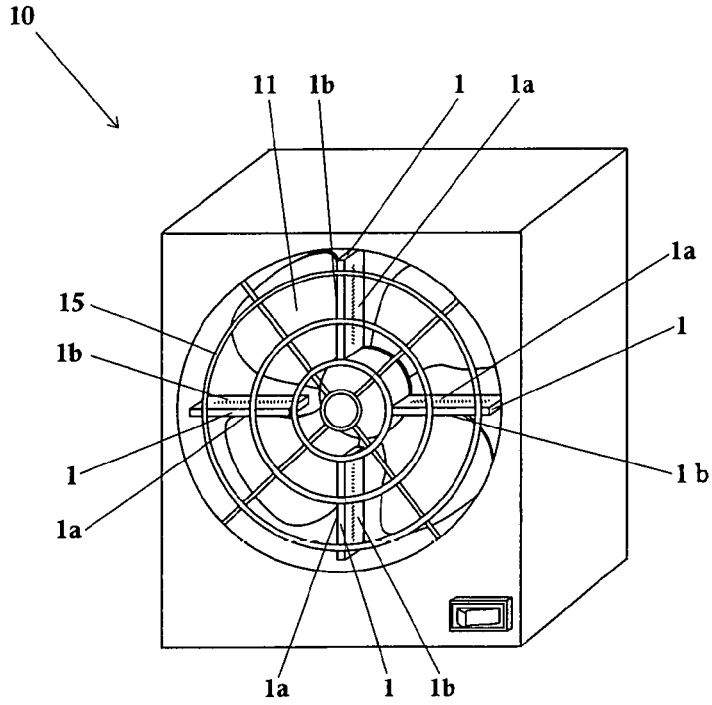
FIG. 16 is a perspective view of another example of the neutralizer according to the present invention.

A concrete example in which the positive ion generating face and the negative ion generating face are not arranged in the same space is, for example, that top face sides of upper two ion generating elements 1 are made positive ion generating faces (faces with discharge electrodes 1*a*) respectively while bottom face sides of lower two ion generating elements 1 are made positive ion generating faces (faces with discharge electrodes 1*a*) respectively in FIG. 13. In FIG. 16, a right face side of an upper ion generating element 1 and a top face side of a right ion generating element 1 are made positive ion generating faces (faces with discharge electrodes 1*a*) respectively, while a left face side of a lower ion generating element 1 and a bottom face side of a left side ion generating element 1 are made positive ion generating faces (faces with discharge electrodes 1*a*) respectively.

Figure 15:
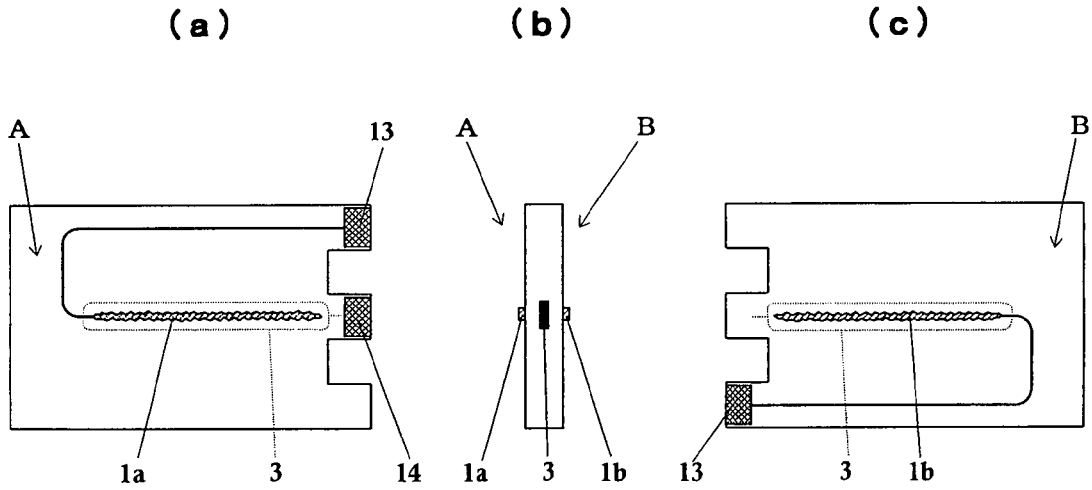
FIG. 15 is a block diagram of an example of the ion generating element shown in FIG. 14.

By constituting the ion generating element 1 to be attached detachably to the electrode socket 12 as shown in FIG. 14, replacement and cleaning after removal are facilitated, thereby improving maintainability. The detachable ion generating element 1 can have a constitution, for example, as shown in FIG. 15 {(*a*) shows a front face (A) side, (*b*) shows a section and (*c*) shows a back face (B) side}. In FIGS. 14 and 15, the numeral 13 is a discharge electrode contact, and the numeral 14 is an induction electrode contact.

The arrangement position of the ion generating element 1 is not restricted to the constitution as shown in FIG. 13, and can be other constitutions such as one as shown in FIG. 16. In a neutralizer 10 as shown in FIG. 16, four ion generating elements 1 are provided radially from a location near to the central axis of a propeller fan 11 with their front sides covered by a finger guard 15.

Figure 17:
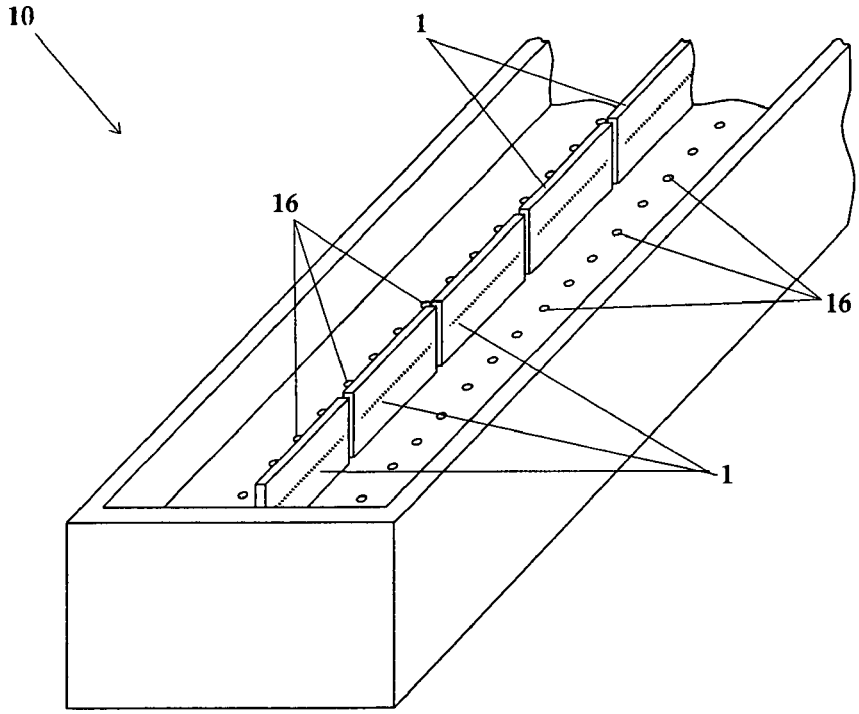
FIG. 17 is a perspective view of still another example of the neutralizer according to the present invention.

The neutralizer of the present invention is not restricted to the fan-type neutralizer as shown in FIGS. 13 and 16, and can have a constitution as shown in FIG. 17, for example. A neutralizer 10 as shown in FIG. 17 is classified into a bar-type neutralizer employing compressed air as a delivering means of ions.

More specifically, at least one ion generating element 1 is arranged linearly, and outlets 16 of compressed air are spaced uniformly on both sides of the ion generating element 1 with the element 1 making a boundary, for example. Ions generated by the ion generating element 1 are delivered far by the air flow rate. In addition, the same symbols represent the same members and constitutions.

The ion generating element 1 used in the neutralizer as shown in FIGS. 16 and 17 is different in a direction of mounting to the neutralizer 10 from the neutralizer as shown in FIG. 13. Therefore, the element 1 has a detaching direction as shown in FIG. 18 and has a constitution as shown in FIG. 19.

Since the neutralizer of the present invention as shown in FIGS. 13, 16 and 17 is capable of efficiently arranging the ion generating element 1 inside of the air flow, delivery by the air flow is carried out very efficiently. Moreover, when a target for diselectrification is at a relatively short distance, diselectrification without a delivering source by compressed air is possible. Therefore, it becomes possible to constitute a neutralizer without use of air flow.

In the neutralizer of the present invention, a control system such that on and off of an output voltage are controlled is preferably used as an adjusting means adjusting an ion balance (ion concentration). However, the ion balance may be adjusted by other control systems such as an output current control, a power supply bias control, an induction electrode bias control, etc. In applications requiring accuracy of the ion balance, it is preferable to employ a method for ensuring the accuracy, for example, by sensing conditions of ion generation.

Figure 18:
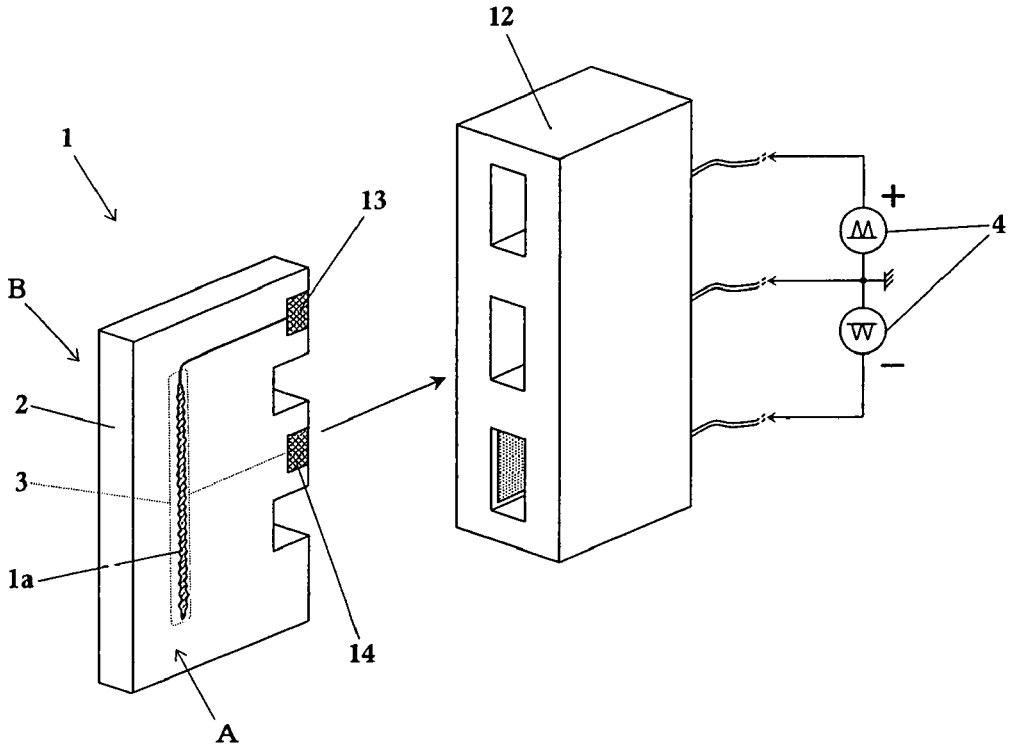
FIG. 18 is a perspective view of another example of the ion generating element with the detachable structure.
Figure 19:
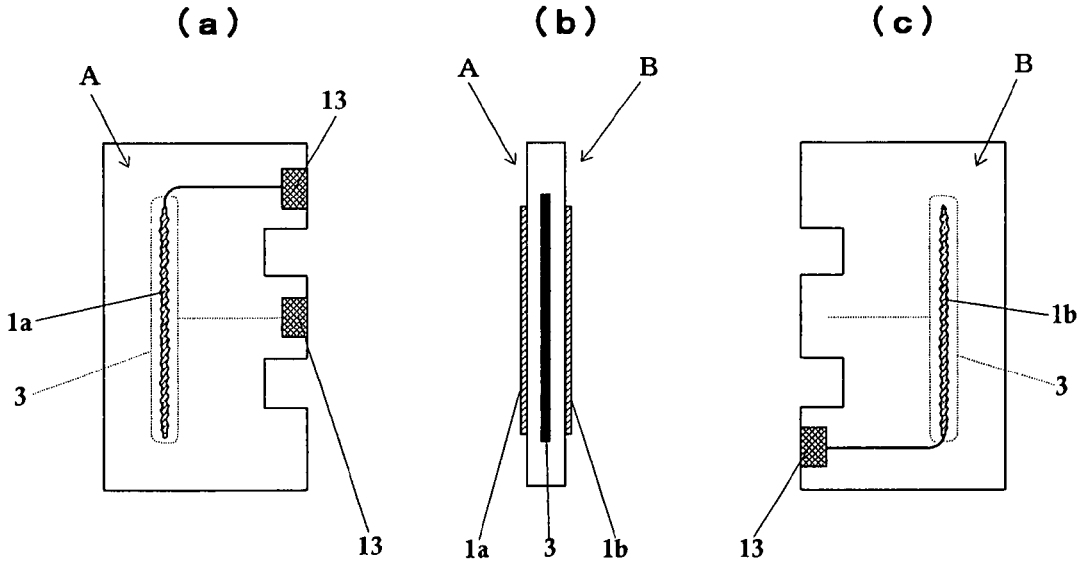
FIG. 19 is a block diagram of an example of the ion generating element shown in FIG. 18.

As for facilitation of maintainability which is essential similar to the importance of the ion balance as described above, if the ion generating element 1 is configured to be detached by the electrode socket 12 as in examples of FIGS. 14 and 18, replacement and cleaning work are facilitated, whereby maintainability is improved.

The ion generating element 1 used in the neutralizer 10 of the present invention can be driven with low voltage as described above. Since a risk is reduced, the ion generating element 1 can be constituted to be exposed in front or on the front face side of the neutralizer 10. By constituting the ion generating element 1 to be exposed, not only is replacement and cleaning in maintenance work easy, but also the number of components blocking generated ions is reduced, whereby ion generating efficiency is further improved.

INDUSTRIAL APPLICABILITY

An ion generating element, an ion generator and a neutralizer according to the present invention have a simply constituted electrode structure and can be used in place of conventional ion generating elements, ion generators and neutralizers.

The invention claimed is:

1. An ion generating element comprising:

a dielectric body with at least two faces; at least two discharge electrodes arranged on at least two faces of the dielectric body; and an induction electrode arranged inside of the dielectric body and subjected to an action of at least two discharge electrodes, wherein positive ions and negative ions are generated on the different faces of the dielectric body.

2. The ion generating element according to claim 1, wherein the dielectric body is a tabular member with a front face and a back face, and positive ions are generated from either one of the faces and negative ions are generated from the other face.

3. The ion generating element according to claim 1, wherein the number of the induction electrode is one.

4. The ion generating element according to claim 1, wherein the discharge electrode is composed of a linear conductive material with a plurality of fine protrusions.

5. The ion generating element according to claim 1, wherein the induction electrode is composed of a linear conductive material opposed to the discharge electrode.

6. An ion generator is constituted;

wherein a driving voltage is applied between the discharge electrodes and induction electrode of the ion generating element according to claim 1, and discharge caused according to a potential difference generates ions from at least two faces of the dielectric body.

7. The ion generator according to claim 6, further comprising a delivering means delivering generated ions by air flow.

8. The ion generator according to claim 7, wherein the dielectric body is arranged along a direction of the air flow so as to distribute a face generating positive ions and a face generating negative ions on both sides thereof directly to the direction of the air flow in order that the both faces are placed under equal air flow environments.

9. The ion generator according to claim 6, further comprising an ion concentration adjusting means changing an ion amount of at least either of positive ions and negative ions to be generated.

10. A neutralizer performing diselectrification with use of the ion generator according to claim 6.

* * * * *